US010555860B2

(12) United States Patent
Hinton et al.

(10) Patent No.: US 10,555,860 B2
(45) Date of Patent: Feb. 11, 2020

(54) SURGICAL TABLES

(71) Applicant: Eschmann Holdings Limited, Lancing, West Sussex (GB)

(72) Inventors: Jeremy Hinton, Lancing (GB); Alessandro Capoia, Lancing (GB)

(73) Assignee: Eschmann Holdings Limited, Lancing, West Sussex (GB)

( * ) Notice: Subject to any disclaimer, the term of this patent is extended or adjusted under 35 U.S.C. 154(b) by 529 days.

(21) Appl. No.: 14/903,074

(22) PCT Filed: Jul. 7, 2014

(86) PCT No.: PCT/EP2014/064472
§ 371 (c)(1),
(2) Date: Jan. 6, 2016

(87) PCT Pub. No.: WO2015/004067
PCT Pub. Date: Jan. 15, 2015

(65) Prior Publication Data

US 2016/0151220 A1 Jun. 2, 2016

(30) Foreign Application Priority Data

Jul. 9, 2013 (GB) ..... 1312307.0

(51) Int. Cl.
*A61G 13/10* (2006.01)
*A61G 13/08* (2006.01)
(Continued)

(52) U.S. Cl.
CPC ..... *A61G 13/104* (2013.01); *A61G 1/0212* (2013.01); *A61G 1/0237* (2013.01);
(Continued)

(58) Field of Classification Search
CPC ..... A61G 13/104; A61G 13/06; A61G 13/02; A61G 13/08; A61G 13/04; A61G 7/012;
(Continued)

(56) References Cited

U.S. PATENT DOCUMENTS 3,028,732 A * 4/1962 Hyman ..... A61G 13/06 280/43.22
4,186,917 A * 2/1980 Rais ..... A61G 13/02 5/614
(Continued)

FOREIGN PATENT DOCUMENTS

EP 0630637 A1 12/1994
EP 0917867 A1 5/1999
(Continued)

OTHER PUBLICATIONS

Int'l. Search Report and Written Opinion dated Oct. 28, 2014 in priority application PCT/EP2014/064472.
(Continued)

*Primary Examiner* — David R Hare
(74) *Attorney, Agent, or Firm* — Polsinelli PC

(57) ABSTRACT

Surgical table comprising: a base comprising a chassis and rotatably connected to the chassis a plurality of wheels for supporting the surgical table on a floor, a first of the wheels being drivable and comprised in a swivel castor rotatably connected to the chassis; a column extending from the chassis; a tabletop coupled to the column and providing a patient support surface; and a drive system for causing rotation of the first wheel relative to the chassis thereby to drive the surgical table along the floor. Also disclosed are surgical tables with a drive system for causing rotation of a wheel of the table in dependence on one or more of a state
(Continued)

of a dead man's switch of the table, a height of a column of the table, a state of a brake of the table, and a state of a power supply of the table.

15 Claims, 5 Drawing Sheets

(51) Int. Cl.
*A61G 7/012* (2006.01)
*A61G 1/02* (2006.01)
*A61G 13/06* (2006.01)

(52) U.S. Cl.
CPC ..... *A61G 1/0275* (2013.01); *A61G 7/012* (2013.01); *A61G 13/06* (2013.01); *A61G 13/08* (2013.01)

(58) Field of Classification Search
CPC ..... A61G 7/018; A61G 5/04; A61G 5/041; A61G 1/02; A61G 1/0212; A61G 1/0237; A61G 1/0275
See application file for complete search history.

(56) References Cited

U.S. PATENT DOCUMENTS 4,761,000 A * 8/1988 Fisher ..... A61G 13/02 5/600
4,998,320 A * 3/1991 Lange ..... B60B 33/021 16/35 R
5,083,625 A * 1/1992 Bleicher ..... B62D 61/10 180/202
5,116,032 A * 5/1992 Strachan ..... A61G 13/06 254/93 R
5,220,698 A * 6/1993 Hannant ..... A61G 13/02 5/424
5,535,465 A * 7/1996 Hannant ..... A61G 7/012 280/43.23
5,628,078 A 5/1997 Pennington et al.
6,321,878 B1 * 11/2001 Mobley ..... A61G 7/00 188/1.12
6,330,926 B1 * 12/2001 Heimbrock ..... A61G 7/018 180/65.1
7,302,717 B2 * 12/2007 Reinke ..... B60B 33/0021 5/600
7,698,760 B2 * 4/2010 Reckelhoff ..... A61G 7/05 16/35 R
7,882,582 B2 * 2/2011 Kappeler ..... A61G 7/018 5/510
7,886,377 B2 * 2/2011 Hamberg ..... A61G 7/0528 5/600
8,442,738 B2 * 5/2013 Patmore ..... A61G 1/048 180/19.1
8,757,308 B2 * 6/2014 Bhai ..... B60L 3/10 180/65.1
9,801,592 B2 * 10/2017 Stanton ..... A61B 5/055
2002/0170116 A1 11/2002 Borders et al.
2006/0213698 A1 * 9/2006 Gaetani ..... B62D 5/0418 180/6.3
2006/0242765 A1 11/2006 Skripps et al.
2007/0136947 A1 6/2007 Limpert
2007/0241529 A1 * 10/2007 Stroh ..... A61G 7/08 280/202
2007/0245488 A1 * 10/2007 Zimbalista ..... A61G 7/0507 5/86.1
2009/0199674 A1 * 8/2009 Schena ..... B62D 1/14 74/496
2010/0180380 A1 * 7/2010 Van Scheppingen .... A61G 7/08 5/510
2010/0235995 A1 9/2010 Liang
2011/0277241 A1 * 11/2011 Schejbal ..... A61G 7/018 5/510
2012/0063838 A1 3/2012 Sahu et al.
2012/0198620 A1 * 8/2012 Hornbach ..... A61G 7/08 5/510
2012/0205509 A1 8/2012 Marugg
2013/0019883 A1 1/2013 Worm et al.
2013/0129416 A1 5/2013 Huggler et al.

FOREIGN PATENT DOCUMENTS

EP 3019133 B1 10/2017
GB 2516051 B 1/2015
JP 1297054 11/1989
JP 06114087 4/1994
WO 200000152 A1 1/2000
WO 2002023057 A1 3/2002
WO 2002058617 A2 8/2002
WO 200303802 A1 4/2003
WO 200303802 A2 4/2003
WO 2010039102 A1 8/2010
WO 2013069952 A1 5/2013

OTHER PUBLICATIONS

Search and Examination Report dated Dec. 4, 2013 in priority application GB1312307.0.
Search and Examination Report dated May 27, 2016 in corresponding application GB1606240.8.
Int'l. Search Report and Written Opinion dated Oct. 28, 2014 in corresponding application PCT/EP2014/064472.
Search and Examiner Report dated Dec. 4, 2013 in corresponding application GB1312307.0.
Int'l. Search Report and Written Opinion dated Jan. 7, 2015 in corresponding application PCT/EP2014/062471.
Search and Examination Report dated May 12, 2016 in corresponding applicaton GB1606232.5.
Int'l. Search Report and Written Opinion dated Mar. 20, 2015 in corresponding application PCT/EP2014/064473.
Search and Examination Report dated Dec. 4, 2013 in corresponding application GB1312522.4.

* cited by examiner

SURGICAL TABLES

FIELD OF THE INVENTION

The present invention relates to surgical tables.

BACKGROUND

Surgical tables, or operating tables, comprising a base for standing on a floor, a column extending from the base, and a tabletop providing a patient support surface are well known. WO2003/030802 discloses such a surgical table in which the base includes a number of castors and fixed wheels for permitting the table to be moved along a floor.

Also, it is known to provide a surgical table with a drivable wheel in contact with the floor for use in driving the surgical table along the floor.

SUMMARY OF THE INVENTION

There is a need for a surgical table with a more compact mechanism for driving the surgical table along a floor.

There also is a need for a surgical table having a drivable wheel that is more safely drivable along a floor.

There further is a need for a surgical table with a mechanism for avoiding inadvertent movement of the table, e.g. when a patient supported by the table is undergoing surgery.

There also is a need for a surgical table with a mechanism for ensuring that a power supply of the table has above a certain degree of charge.

A first aspect of the present invention provides a surgical table comprising: a base comprising a chassis and rotatably connected to the chassis a plurality of wheels for supporting the surgical table on a floor, a first of the wheels being drivable and comprised in a swivel castor rotatably connected to the chassis; a column extending from the chassis; a tabletop coupled to the column and providing a patient support surface; and a drive system for causing rotation of the first wheel relative to the chassis thereby to drive the surgical table along the floor.

Optionally, the swivel castor comprises a frame rotatably connected to the chassis, and the first wheel rotatably connected to the frame and comprising an integral electric motor.

Optionally, an orientation of the frame of the swivel castor relative to the chassis is lockable. Further optionally the tabletop has a longitudinal direction and an orientation of the frame of the swivel castor relative to the chassis is lockable with the first wheel longitudinally oriented.

Optionally, the total number of wheels comprised in the surgical table for supporting the surgical table on the floor is only four.

Optionally, the chassis has first and second opposed end portions, wherein the plurality of wheels comprises the first wheel at the first end portion, a second wheel comprised in a second swivel castor at the first end portion and third and fourth wheels at the second end portion.

Optionally, the third and fourth wheels are comprised in respective third and fourth swivel castors.

Optionally, the third and fourth wheels are third and fourth fixed wheels. Further optionally, the tabletop has a longitudinal direction and the third and fourth fixed wheels are first and second longitudinally oriented fixed wheels.

Optionally, the surgical table comprises a handlebar at one end of the tabletop, wherein the drive system comprises a selector mounted on the handlebar for selecting a speed at which the drive system rotates the first wheel.

Optionally, the selector is disposable in first and second modes, and the drive system is for causing the rotation in dependence on the mode of the selector.

Optionally, the tabletop has a longitudinal direction and the handlebar is at one longitudinal end of the tabletop, and/or the handlebar is removably fixed to the tabletop.

Optionally, the tabletop has a transverse direction orthogonal to the longitudinal direction, and at least a portion of the handlebar is elongate in the transverse direction.

Optionally, the drive system is configured to not cause the rotation when the selector is in the first mode.

Optionally, the drive system is configured to cause the rotation when the selector is in the second mode.

Optionally, the selector is for selecting a direction in which the drive system rotates the first wheel.

Optionally, the drive system comprises a dead man's switch that is switchable between first and second states and biased to the first state, and the drive system is for causing the rotation in dependence on the state of the dead man's switch.

Optionally, the drive system is configured to not cause the rotation when the dead man's switch is in the first state.

Optionally, the drive system is for causing the rotation only when the dead man's switch is in the second state.

Optionally, the drive system is configured to cause the rotation when the selector in the second mode only when the dead man's switch is in the second state.

Optionally, the dead man's switch is mounted on the handlebar.

A second aspect of the present invention provides a surgical table comprising: a base comprising a chassis and rotatably connected to the chassis a plurality of wheels for supporting the surgical table on a floor; a column extending from the chassis; a tabletop coupled to the column and providing a patient support surface; a handlebar at one end of the tabletop; and a drive system for causing rotation of one or more of the wheels relative to the chassis thereby to drive the surgical table along the floor, the drive system comprising a selector mounted on the handlebar for selecting a speed at which the drive system rotates the one or more wheels.

Optionally, the selector is disposable in first and second modes, and the drive system is for causing the rotation in dependence on the mode of the selector.

Optionally, the tabletop has a longitudinal direction and the handlebar is at one longitudinal end of the tabletop, and/or the handlebar is removably fixed to the tabletop.

Optionally, the tabletop has a transverse direction orthogonal to the longitudinal direction, and at least a portion of the handlebar is elongate in the transverse direction.

Optionally, the drive system is configured to not cause the rotation when the selector is in the first mode.

Optionally, the drive system is configured to cause the rotation when the selector is in the second mode.

Optionally, the selector is for selecting a direction in which the drive system rotates the one or more wheels.

Optionally, the drive system comprises a dead man's switch that is switchable between first and second states and biased to the first state, and the drive system is for causing the rotation in dependence on the state of the dead man's switch.

Optionally, the drive system is configured to not cause the rotation when the dead man's switch is in the first state.

Optionally, the drive system is for causing the rotation only when the dead man's switch is in the second state.

Optionally, the drive system is configured to cause the rotation when the selector is in the second mode only when the dead man's switch is in the second state.

Optionally, the dead man's switch is mounted on the handlebar.

A third aspect of the present invention provides a surgical table comprising: a base comprising a chassis and rotatably connected to the chassis a plurality of wheels for supporting the surgical table on a floor; a column extending from the chassis; a tabletop coupled to the column and providing a patient support surface; and a drive system comprising a dead man's switch switchable between first and second states and biased to the first state, wherein the drive system is for causing rotation of one or more of the wheels relative to the chassis thereby to drive the surgical table along the floor in dependence on the state of the dead man's switch.

Optionally, the drive system is configured to not cause the rotation when the dead man's switch is in the first state.

Optionally, the drive system is for causing the rotation only when the dead man's switch is in the second state.

Optionally, the drive system comprises a selector for selecting a speed at which the drive system rotates the one or more wheels.

Optionally, the selector is disposable in first and second modes, and the drive system is for causing the rotation in dependence on the mode of the selector.

Optionally, the drive system is configured to not cause the rotation when the selector is in the first mode.

Optionally, the drive system is configured to cause the rotation when the selector is in the second mode only when the dead man's switch is in the second state.

Optionally, the selector is for selecting a direction in which the drive system rotates the one or more wheels.

Optionally, the surgical table comprises a handlebar at one end of the tabletop, wherein the dead man's switch is mounted on the handlebar. Further optionally, the handlebar is removably fixed to the tabletop. Further optionally, the selector is mounted on the handlebar.

Optionally, the surgical table comprises a handlebar at one end of the tabletop, wherein the selector is mounted on the handlebar. Further optionally, the handlebar is removably fixed to the tabletop.

Optionally, the tabletop has a longitudinal direction, and the handlebar is at one longitudinal end of the tabletop.

Optionally, the tabletop has a transverse direction orthogonal to the longitudinal direction, and at least a portion of the handlebar is elongate in the transverse direction.

A fourth aspect of the present invention provides a surgical table comprising: a base comprising a chassis and rotatably connected to the chassis a plurality of wheels for supporting the surgical table on a floor; a column of adjustable height extending from the chassis; a tabletop coupled to the column and providing a patient support surface; and a drive system for causing rotation of one or more of the wheels relative to the chassis thereby to drive the surgical table along the floor in dependence on the height of the column.

Optionally, the drive system is for causing the rotation only when the height of the column is less than a predetermined threshold height.

Optionally, the surgical table comprises a brake switchable between a first state, at which the brake hinders or prevents movement of the surgical table along the floor, and a second state, at which the brake permits movement of the surgical table along the floor, wherein the drive system is for causing the rotation in dependence on the state of the brake.

Optionally, the drive system is for causing the rotation only when the brake is in the second state.

Optionally, the surgical table comprises a power supply for the drive system, wherein the drive system comprises a power supply monitor for determining a state of the power supply and outputting an indication indicative of the state of the power supply in dependence on the state of the power supply, and wherein the drive system is for causing the rotation in dependence on the indication output by the power supply monitor.

Optionally, the power supply is an electrical power supply comprising one or more cells or batteries, and wherein the state of the power supply comprises a degree of charge of the one or more cells or batteries.

Optionally, the drive system is for causing the rotation only when the indication output by the power supply monitor comprises an indication that the degree of charge of the one or more cells or batteries is above a predetermined threshold degree of charge.

A fifth aspect of the present invention provides a surgical table comprising: a base comprising a chassis and rotatably connected to the chassis a plurality of wheels for supporting the surgical table on a floor; a column extending from the chassis; a tabletop coupled to the column and providing a patient support surface; a brake switchable between a first state, at which the brake hinders or prevents movement of the surgical table along the floor, and a second state, at which the brake permits movement of the surgical table along the floor; and a drive system for causing rotation of one or more of the wheels relative to the chassis thereby to drive the surgical table along the floor in dependence on the state of the brake.

Optionally, the drive system is for causing the rotation only when the brake is in the second state.

Optionally, the column is of adjustable height, and the drive system is for causing the rotation in dependence on the height of the column.

Optionally, the drive system is for causing the rotation only when the height of the column is less than a predetermined threshold height.

Optionally, the surgical table comprises a power supply for the drive system, wherein the drive system comprises a power supply monitor for determining a state of the power supply and outputting an indication indicative of the state of the power supply in dependence on the state of the power supply, and wherein the drive system is for causing the rotation in dependence on the indication output by the power supply monitor.

Optionally, the power supply is an electrical power supply comprising one or more cells or batteries, and wherein the state of the power supply comprises a degree of charge of the one or more cells or batteries.

Optionally, the drive system is for causing the rotation only when the indication output by the power supply monitor comprises an indication that the degree of charge of the one or more cells or batteries is above a predetermined threshold degree of charge.

A sixth aspect of the present invention provides a surgical table comprising: a base comprising a chassis and rotatably connected to the chassis a plurality of wheels for supporting the surgical table on a floor; a column extending from the chassis; a tabletop coupled to the column and providing a patient support surface; a drive system; and a power supply for the drive system; wherein the drive system comprises a power supply monitor for determining a state of the power supply and outputting an indication indicative of the state of the power supply in dependence on the state of the power supply, and wherein the drive system is for causing rotation of one or more of the wheels relative to the chassis thereby to drive the surgical table along the floor in dependence on the indication output by the power supply monitor.

Optionally, the power supply is an electrical power supply comprising one or more cells or batteries, and wherein the state of the power supply comprises a degree of charge of the one or more cells or batteries.

Optionally, the drive system is for causing the rotation only when the indication output by the power supply monitor comprises an indication that the degree of charge of the one or more cells or batteries is above a predetermined threshold degree of charge.

Optionally, the column is of adjustable height, and the drive system is for causing the rotation in dependence on the height of the column.

Optionally, the drive system is for causing the rotation only when the height of the column is less than a predetermined threshold height.

Optionally, the surgical table comprises a brake switchable between a first state, at which the brake hinders or prevents movement of the surgical table along the floor, and a second state, at which the brake permits movement of the surgical table along the floor, wherein the drive system is for causing the rotation in dependence on the state of the brake.

Optionally, the drive system is for causing the rotation only when the brake is in the second state.

It is to be noted that any combination of the above-described optional features of the surgical table of any one of the first to third aspects of the present invention may be provided in the surgical table of any one of the fourth to sixth aspects of the present invention. Also, it is to be noted that any combination of the above-described optional features of the surgical table of any one of the fourth to sixth aspects of the present invention may be provided in the surgical table of any one of the first to third aspects of the present invention.

BRIEF DESCRIPTION OF THE DRAWINGS

Preferred embodiments of the present invention will now be described by way of example only with reference to the accompanying drawings, in which.

DETAILED DESCRIPTION

Figure 1:
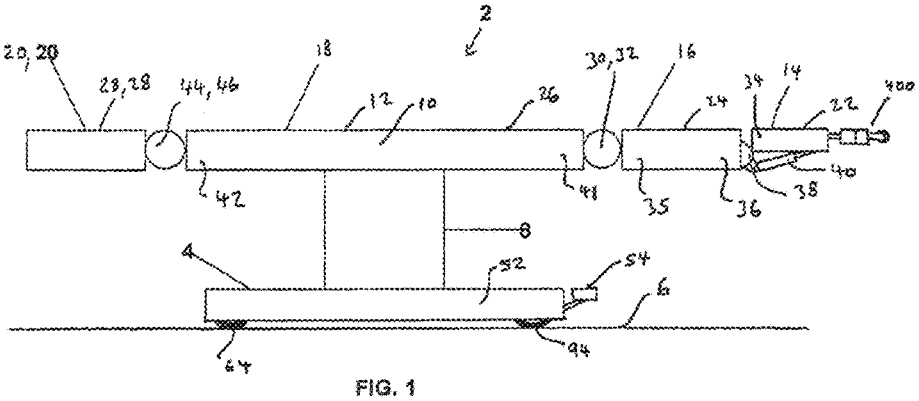
FIG. 1 is a schematic side view of a surgical table in accordance with an embodiment of the present invention.

Referring to FIG. 1, a surgical table, designated generally as 2, includes a base 4, which stands on a floor 6, a column 8 of adjustable height extending from the base 4 and a tabletop 10 providing a patient support surface 12.

As depicted in FIG. 1, the tabletop 10 is divided into five sections, namely a head section 14, an upper torso section 16, a lower torso section 18 and a pair of laterally adjacent leg sections 20, 20, of which only one is shown in FIG. 1. Each of the sections of the tabletop 10 provides a portion of the patient support surface 12, and each of the sections has a respective separate mattress 22, 24, 26, 28, 28.

The lower torso section 18 is coupled to the column 8. A lower end 35 of the upper torso section 16 is detachably mounted on an upper end 41 of the lower torso section 18 by means of transversely adjacent first and second pivot joints 30, 32, which define a transverse axis about which the upper torso section 16 can be displaced relative to the lower torso section 18.

Each of the leg sections 20 is detachably mounted on a lower end 42 of the lower torso section 18 by a respective one of transversely adjacent third and fourth pivot joints 44, 46, of which only one is visible in FIG. 1, for displacement relative to the lower torso section 18 about a transverse axis defined by the respective one of third and fourth pivot joints 44, 46.

A lower end 34 of the head section 14 is detachably mounted on an upper end 36 of the upper torso section 16 by means of a fifth pivot joint 38 defining a transverse axis about which the head section 14 can be displaced relative to the upper torso section 16. The angle of inclination of the head section 14 is controlled manually by means of a pair of conventional adjustable struts 40, only one of which is shown in FIG. 1, secured to and extending between the underside of the head section 14 and the upper torso section 16, one on each side of the tabletop 10. The struts 40 may be hydraulic or electric actuators or lockable gas springs.

The provision of the five pivot joints 30, 32, 38, 44, 46 permits the five sections 14, 16, 18, 20, 20 selectively to be inclined relative to adjacent sections 14, 16, 18, 20, 20 thereby to dispose the tabletop 10 in a selected configuration. Moreover, that the head section 14 is detachable from the upper torso section 16, and each of the upper torso section 16 and the leg sections 20, 20 is detachable from the lower torso section 18 means that the table 2 may be made compact for storage.

The surgical table 2 also includes mechanisms for inclining the whole tabletop 10 relative to the column 8 and base 4 and relative to the horizontal about transverse and longitudinal axes of the tabletop 10. Inclination about the transverse axis of the tabletop 10 is referred to in the art as "trending", while inclination about the longitudinal axis of the tabletop 10 is referred to as "tilting".

As used herein, the longitudinal axis of the tabletop is the major axis of the tabletop and the transverse axis of the tabletop is the orthogonal minor axis of the tabletop. A longitudinal direction of the tabletop is parallel to the major axis and a transverse direction of the tabletop is parallel to the minor axis. That is, the transverse direction of the tabletop is perpendicular to, or orthogonal to, the longitudinal direction of tabletop.

Figure 2:
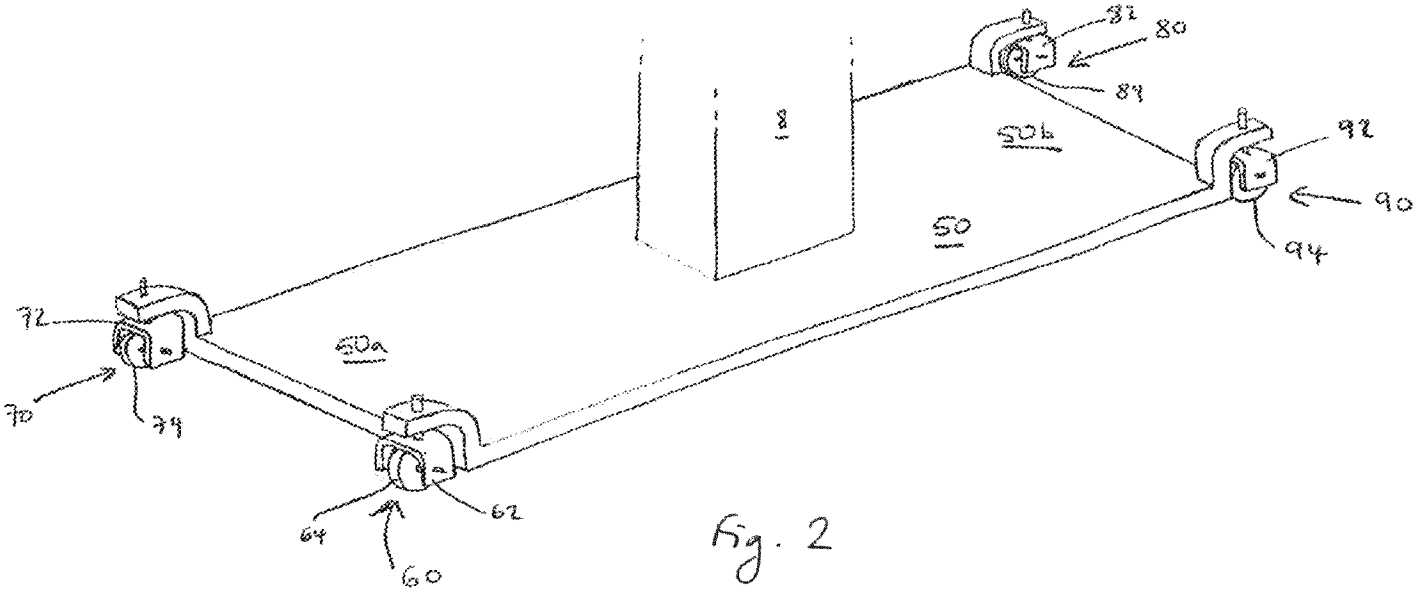
FIG. 2 is a schematic perspective view of the base of the surgical table of FIG. 1.

As shown in FIGS. 1 and 2, the base 4 comprises the chassis 50, a plurality of wheels 64, 74, 84, 94 (herein the first, second, third and fourth wheels, respectively) rotatably connected to the chassis 50 and for supporting the surgical table 2 on a floor 6, and a cover 52 attached to the chassis 50 and encasing the majority of each of the wheels 64, 74, 84, 94. Each of the wheels 64, 74, 84, 94 is comprised in a respective swivel castor 60, 70, 80, 90 rotatably connected to the chassis 50. More specifically, each swivel castor 60, 70, 80, 90 comprises a respective frame or fork 62, 72, 82, 92 that is rotatably connected to the chassis 50 about a respective first axis, and a respective one of the wheels 64, 74, 84, 94 rotatably connected to the frame 62, 72, 82, 92 about a respective second axis, wherein the second axis is orthogonal to the first axis.

As used herein, the phrase "X rotatably connected to Y about an axis Z" means X is connected to Y and is rotatable relative to Y about axis Z.

In the illustrated embodiment, each of the frames 62, 72, 82, 92 is rotatably connected to the chassis 50 for free rotation about 360 degrees about the respective first axes relative to the chassis 50, and respective orientations of the frames 62, 72, 82, 92 relative to the chassis 50 are not lockable. However, in a variation to this embodiment, the orientation of the frame 62 of the first swivel castor 60 relative to the chassis 50 may be lockable, so that relative rotation of the frame 62 and the chassis 50 selectively is preventable. Preferably, the orientation of the frame 62 of the first swivel castor 60 relative to the chassis 50 is lockable with the first wheel 64 of the first castor 60 rotatable relative to the chassis 50 about an axis that extends orthogonally to the longitudinal direction of the tabletop 10 and parallel to the transverse axis of the tabletop 10, so that the wheel 64 of the first swivel castor 60 is longitudinally oriented. Preferably, the orientation of the frame 72 of the second swivel castor 70 relative to the chassis 50 is lockable in the same direction as the frame 62, so that the second wheel 74 of the second swivel castor 70 also is longitudinally oriented. In other variations to this embodiment, an orientation of one or more or all of the frames 62, 72, 82, 92 relative to the chassis 50 is so lockable.

Figure 4:
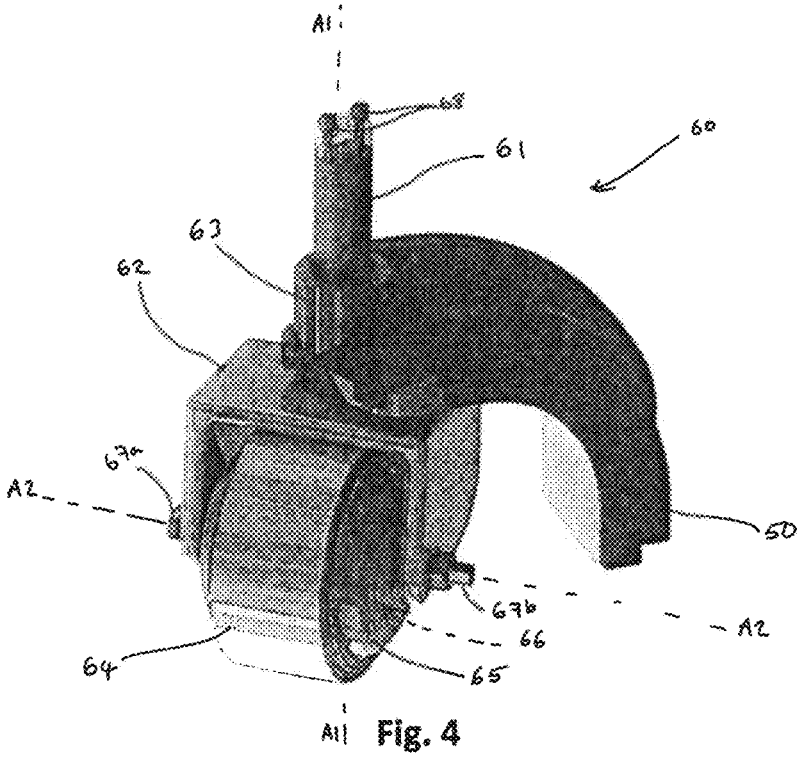
FIG. 4 is a perspective view of a swivel castor including the drivable wheel of the surgical table of FIG. 1.

The first swivel castor 60 will be described in more detail with reference to FIG. 4. The first swivel castor 60 comprises a spigot 61 that is rotatably connected to the chassis 50 about a first axis A1-A1 via a bearing 63. The frame 62 is mounted to a lower end of the first spigot 61. The bearing 63 facilitates rotation of the spigot 61, and thus the frame 62, relative to the chassis 50 about the first axis A1-A1. The first swivel castor 60 further comprises a hub 65 that is rotatably connected to the frame 62 via a pair of pins 67*a*, 67*b*. The pins 67*a*, 67*b* are immovable relative to the frame 62. The first wheel 64 and the hub 65 are rotatably connected to the pins 67*a*, 67*b* via an electric motor 66 (not expressly shown) disposed within the hub 65. The first swivel castor 60 is configured so that rotation of the motor 66 causes rotation of the first wheel 64 and the hub 65 relative to the pins 67*a*, 67*b* and frame 62 about a second axis A2-A2, which is orthogonal to the first axis A1-A1. That is, the first wheel 64 is drivable relative to the frame 62 and chassis 50 by rotation of the motor 66. Two electrically-conductive paths extend from respective terminals of the motor 66, through the hub 65, through or along the frame 62 and through the spigot 61 to respective terminals 68 at a top end of the spigot 61. The terminals 68 at the top end of the spigot 61 contact respective electrically-conductive ring-shaped sliding contacts (not shown), to each of which sliding contacts is connected an electrically-conductive wire (not shown) that extends to a drive system 100 of the table 2, which drive system 100 will be discussed in more detail below. In variations to the illustrated embodiment, the motor 66 may be electrically connected to the drive system 100 by some other arrangement.

In the illustrated embodiment, the total number of wheels 64, 74, 84, 94 comprised in the surgical table 2 for supporting the surgical table 2 on the floor 6 is only four. Moreover, the chassis 50 has first and second opposed end portions 50*a*, 50*b*. The first swivel castor 60 and the second swivel castor 70 of the swivel castors are rotatably connected to the first end portion 50*a* of the chassis 50. Accordingly, the first wheel 64 and the second wheel 74 of the wheels are at the first end portion 50*a*. On the other hand, a third swivel castor 80 and a fourth swivel castor 90 of the swivel castors are rotatably connected to the second end portion 50*b* of the chassis 50. Accordingly, the third wheel 84 and the fourth wheel 94 of the wheels (which third and fourth wheels 84, 94 are comprised in the third and fourth castors 80, 90, respectively) are at the second end portion 50*b*.

In a variation to this embodiment, the third and fourth wheels 84, 94 may not be comprised in respective swivel castors. In such a variation, the third and fourth wheels 84, 94 may be fixed wheels. That is, directions of respective axes about which the third and fourth wheels 84, 94 are rotatable relative to the chassis 50 may be fixed. For example, the third and fourth wheels 84, 94 may be longitudinally oriented fixed wheels. In other words, the directions of respective axes about which the third and fourth wheels 84, 94 are rotatable relative to the chassis 50 may be fixed and respectively extend orthogonal to the longitudinal direction of the tabletop 10.

The table 2 further comprises a drive system 100 and a power supply 300 for the drive system 100. In the illustrated embodiment, the power supply 300 is an electrical power supply comprising one or more cells or batteries (not shown) mounted on the chassis 50. The drive system 100 is for causing rotation of the first wheel 64 relative to the frame 62 and chassis 50 thereby to drive the surgical table 2 along the floor 6.

Figure 6:
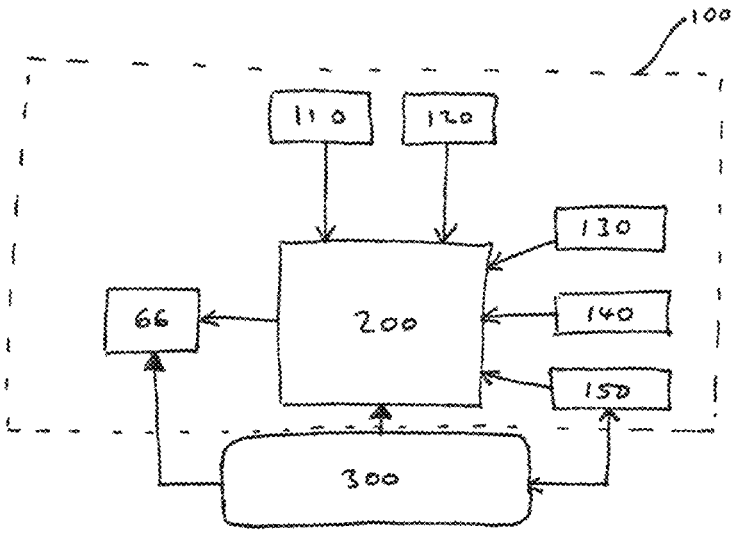
FIG. 6 is a schematic view of components of the surgical table of FIG. 1.

With reference to FIG. 6, the drive system 100 comprises a controller 200, the motor 66 connected to the controller 200 by the above-mentioned electrically-conductive wires (or another arrangement, in the above-mentioned variations to the illustrated embodiment), a selector 110, a dead man's switch 120, a brake state determiner 130, a column height determiner 140 and a power supply monitor 150. Each of the selector 110, dead man's switch 120, brake state determiner 130, column height determiner 140 and power supply monitor 150 is communicatively connected to the controller 200. The controller 200 and the motor 66 are electrically connected to the power supply 300 for drawing electrical power from the power supply 300 in order to operate. The power supply monitor 150 is connected to the power supply 300 in order to determine a degree of charge of the one or more cells or batteries.

Figure 3:
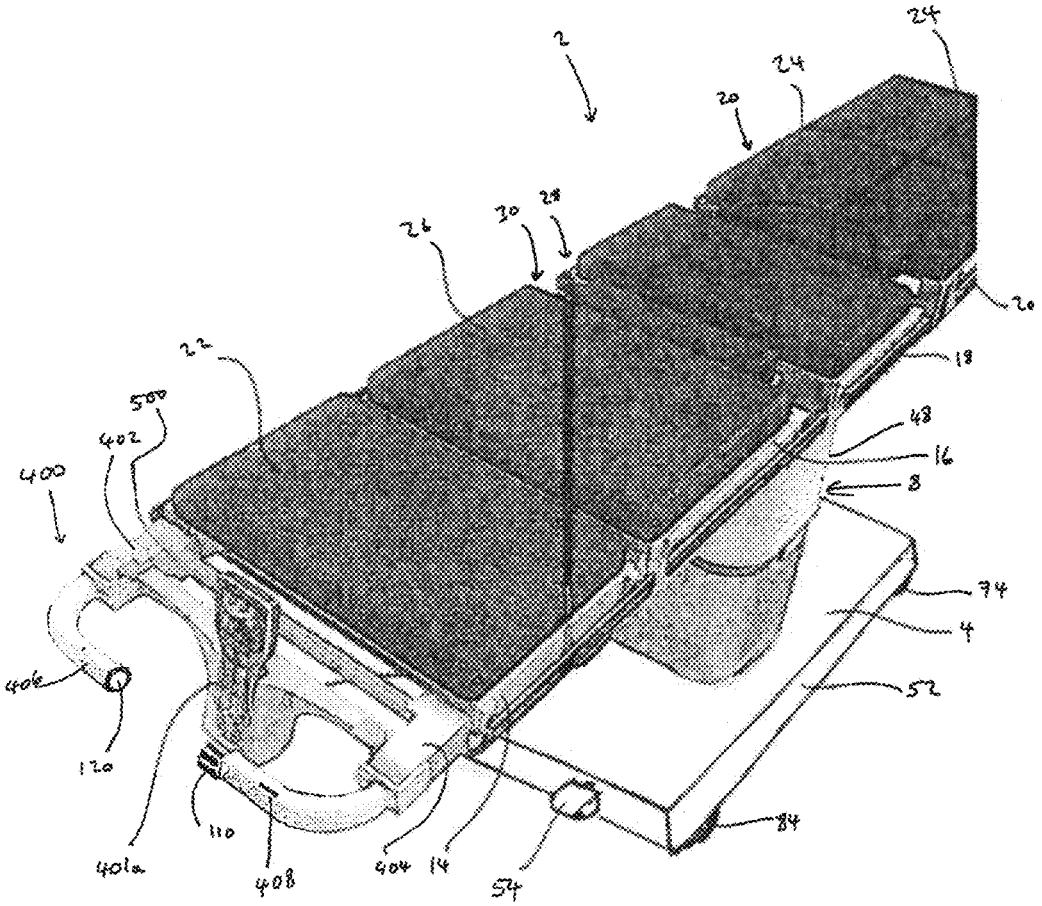
FIG. 3 is a perspective view of the surgical table of FIG. 1.
Figure 5:
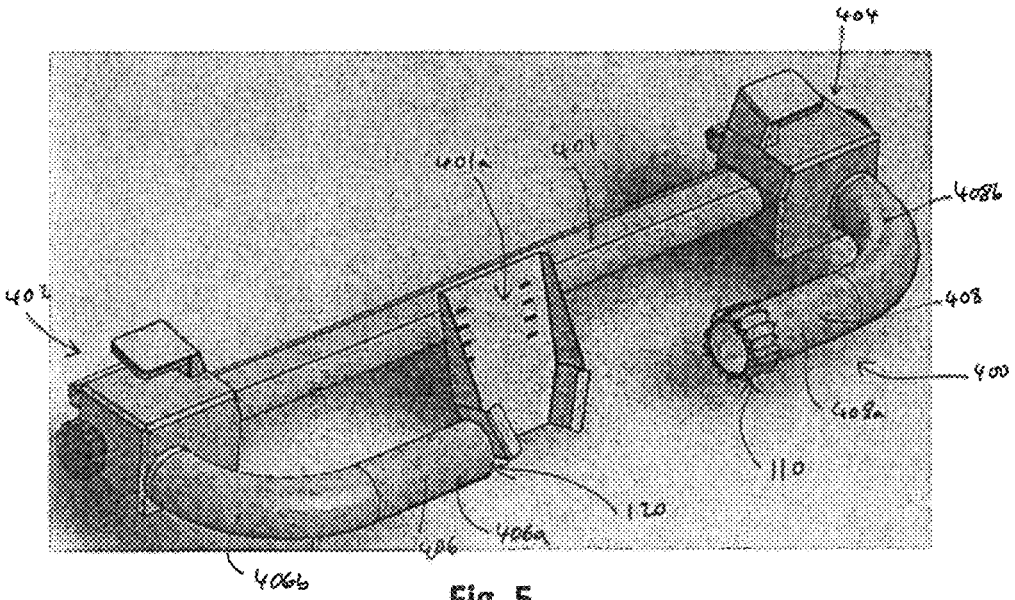
FIG. 5 is a schematic perspective view of the handlebar of the surgical table of FIG. 1.

With reference to FIGS. 3 and 5, the selector 110 and the dead man's switch 120 are mounted on a handlebar 400 that is disposed at one longitudinal end of the tabletop 10. In the illustrated embodiment, the handlebar 400 is disposed at the longitudinal end of the tabletop 10 that is closer to the third and fourth wheels 84, 94 than the first and second wheels 64, 74. More specifically, the handlebar 400 is removably fixed directly to the tabletop 10 by a pair of clamps 402, 404 that clamp to a frame of the head section 14 of the tabletop 10. In a variation to this embodiment, the handlebar 400 is irremovably fixed directly to the tabletop 10. In a further variation to this embodiment, the handlebar 400 may be fixed, removably or irremovably, to the chassis 50 of the base 4. Regardless as to how the handlebar 400 is connected to the rest of the table 2, preferably the handlebar 400 is disposed at one longitudinal end of the tabletop 10.

The handlebar 400 comprises a handlebar frame 401, to which the clamps 402, 404 are fixed, and first and second handles 406, 408 extending from a handlebar frame 401. The handlebar frame 401 includes a holster 401*a* for holding a portable handset 500 (see FIG. 3) that is communicatively connected to a control system of the table 2 and that comprises a user interface via which a user is able to communicate with the control system to effect one or more actions of components of the table 2. In other embodiments, the holster 401*a* and/or handset 500 may be omitted. Each of the first and second handles 406, 408 includes a first portion 406*a*, 408*a* that is elongate in the transverse direction of the tabletop 10 and a second curved portion 406*b*, 408*b* that connects the first portion to the handlebar frame 401. Respective ends of the first portions 406*a*, 408*a* face each other across a gap therebetween in the transverse direction.

The dead man's switch 120 is mounted to the end of the first portion 406*a* of the first handle 406, and the selector 110 is rotatably connected to the end of the first portion 408*a* of the second handle 408. The dead man's switch 120 is switchable manually between first and second states and is biased to the first state. In the illustrated embodiment, the dead man's switch 120 is a push button that is pressable to reach the second state. Release of the dead man's switch 120 causes the pushbutton to spring back to the first, elevated state. In other embodiments, the dead man's switch 120 may comprise a touch sensor, such as a capacitive touch sensor, for detecting a user's hand on the first portion 406*a* of the first handle 406. Other forms of dead man's switch 120 may instead be used.

The dead man's switch 120 is configured to indicate to the controller 200 the state of the dead man's switch 120, in dependence on a position of the push button relative to the handlebar 400. When the push button is at the first position, the dead man's switch 120 indicates to the controller 200 that the dead man's switch 120 is in its first state. When the push button is at the second position, the dead man's switch 120 indicates to the controller 200 that the dead man's switch 120 is in its second state.

In dependence on the indication received from the dead man's switch 120, the controller 200 is configured to determine whether or not to control the motor 66 to cause rotation of the first wheel 64 relative to the frame 62 and chassis 50 thereby to drive the surgical table 2 along the floor 6.

The drive system 100 is for causing, i.e. is configured to cause, the rotation of the first wheel 64 relative to the frame 62 and chassis 50 thereby to drive the surgical table 2 along the floor 6 in dependence on the state of the dead man's switch 120. Specifically, the drive system 100 is prevented from causing, i.e. is configured to not cause, the rotation when the dead man's switch 120 is in the first state. The drive system 100 is operable to cause the rotation only when the dead man's switch 120 is in the second state. That is, causation of the rotation by the drive system 100 is possible only when the dead man's switch 120 is in the second state.

The selector 110 is for selecting a speed at which the drive system 100 rotates the first wheel 64. The selector 110 is disposable manually in first and second modes, and the drive system 100 is for causing, i.e. is configured to cause, the rotation in dependence on the mode of the selector 110. Specifically, the drive system 100 is prevented from causing, i.e. is configured to not cause, the rotation when the selector 110 is in the first mode. The drive system 100 is configured to cause the rotation when the selector 110 is in its second mode, but only when the dead man's switch 120 is in its second state. In a variation to the illustrated embodiment in which the dead man's switch 120 is omitted, the drive system 100 may be configured to cause the rotation when the selector 110 is in its second mode, but preferably still in dependence on one or more other factors, such as a state of a brake of the table 2, and/or a height of the column 8, and/or a state of the power supply 300, as described below.

In the illustrated embodiment the selector 110 comprises a knob or dial that is continuously rotatable relative to the handlebar 400 about an axis orthogonal to the longitudinal direction of the tabletop 10 between a first position and a second position. When the knob is at the first position, the selector 110 is in its first mode, corresponding to a desired rotation speed of the wheel of zero. When the knob is away from the first position, that is at the second position or at a position between the first and second positions, the selector 110 is in its second mode. Within the second mode, the selector 110 is disposable at any one of a plurality of positions corresponding to respective sub-modes, each of the sub-modes corresponding to a respective different desired positive (i.e. forward) rotation speed of the wheel. Accordingly, the selector 110 of the present embodiment is a variable, or continuous, speed controller. The knob may in some embodiments be biased to the first position, whereby the selector 110 is biased to its first mode, so that release of the knob causes the selector 110 to become disposed in its first mode.

The selector 110 is configured to indicate to the controller 200 the mode of the selector 110, in dependence on a position of the knob relative to the handlebar 400. When the knob is at the first position, the selector 110 indicates to the controller 200 that the selector 110 is in its first mode. When the knob is away from the first position, i.e. at the second position or at a position between the first and second positions, the selector 110 indicates to the controller 200 that the selector 110 is in its second mode. More specifically, the selector 110 indicates to the controller 200 which of the plurality of sub-modes the selector 110 is in. In dependence on the indication received from the selector 110, the controller 200 determines whether or not, and if so at what speed, to control the motor 66 to cause the rotation of the first wheel 64 relative to the frame 62 and chassis 50 thereby to drive the surgical table 2 along the floor 6.

In a variation to the present embodiment, the selector 110 also is for selecting a direction in which the drive system 100 rotates the first wheel 64. In this variation embodiment, the selector 110 is disposable in a third mode, and the drive system 100 is for causing, i.e. is configured to cause, forward rotation of the motor 66 when the selector 110 is in the second mode and reverse rotation of the motor 66 when the selector 110 is in the third mode. Specifically, the drive system 100 is configured so that disposing the selector 110 in its third mode causes the drive system 100 to cause reverse rotation of the motor 66, but only when the dead man's switch 120 is in its second state. In this variation embodiment, the knob or dial of the selector 110 is continuously rotatable relative to the handlebar 400 about the axis orthogonal to the longitudinal direction of the tabletop 10 between a third position and the second position via the first position. When the knob is at the first position, the selector 110 is in its first mode, corresponding to a desired rotation speed of the wheel of zero. When the knob is at the third position, or at a position between the first and third positions, the selector 110 is in its third mode. Within the third mode, the selector 110 is disposable at any one of a plurality of positions corresponding to respective sub-modes, each of the sub-modes corresponding to a respective different desired negative (i.e. reverse) rotation speed of the wheel. The knob may still be biased to the first position. When the knob is at the third position, or at a position between the first and third positions, the selector 110 indicates to the controller 200 that the selector 110 is in its third mode. More specifically, the selector 110 indicates to the controller 200 which of the plurality of sub-modes the selector 110 is in. In dependence on the indication received from the selector 110, the controller 200 determines whether or not, and if so at what speed and in what direction, to control the motor 66 to cause the rotation of the first wheel 64 relative to the frame 62 and chassis 50 thereby to drive the surgical table 2 along the floor 6. In a further variation in which the dead man's switch 120 is omitted, the drive system 100 may be configured so that disposing the selector 110 in its third mode causes the drive system 100 to cause the reverse rotation, but preferably still in dependence on one or more other factors, such as a state of a brake of the table 2, and/or a height of the column 8, and/or a state of the power supply 300, as described below.

As mentioned above, the column 8 of the illustrated embodiment is of adjustable height. The surgical table 2 includes a mechanism (not shown) for selectively increasing or decreasing the height of the column 8 (i.e. increasing or decreasing the distance between the base 4 and the tabletop 10), thereby to adjust the height of the column 8 and thus the height of the tabletop 10 above the base 4 and floor 6. The drive system 100 is for causing the rotation of the first wheel 64 relative to the frame 62 and chassis 50 thereby to drive the surgical table 2 along the floor 6 in dependence on the height of the column 8. Specifically, in the illustrated embodiment, the drive system 100 is operable to cause the rotation only when the height of the column 8 is less than a predetermined threshold height. That is, causation of the rotation by the drive system 100 is possible only when the height of the column 8 is less than the predetermined threshold height. The predetermined threshold height could be set as a midpoint between a maximum possible height of the column 8 and a minimum possible height of the column 8.

As mentioned above, the drive system 100 comprises a column height determiner 140 communicatively connected to the controller 200. The column height determiner 140 is configured to determine, e.g. sense, a height of the column 8 and to indicate to the controller 200 the height of the column 8, in dependence on the height of the column 8. In dependence on the indication received from the column height determiner 140, the controller 200 determines whether or not to control the motor 66 to cause the rotation of the first wheel 64 relative to the frame 62 and chassis 50 thereby to drive the surgical table 2 along the floor 6.

The surgical table 2 of the illustrated embodiment also includes a brake (not shown) that is switchable between a first state, at which the brake hinders or prevents movement of the surgical table 2 along the floor 6, and a second state, at which the brake permits movement of the surgical table 2 along the floor 6. Switching of the brake between its first and second states is effected through operation of a foot pedal 54 movably connected to the chassis 50 of the base 4 and exposed outside of the cover 52 of the base 4. In the illustrated embodiment, the brake comprises a member movably connected to the pins 67*a*, 67*b* of one of the castors 60, 70, 80, 90 and having a surface of high friction material, such as rubber, that is selectively contactable with an interior or exterior of the wheel 64, 74, 84, 94 or hub 65, 75, 85, 95 of the castor 60, 70, 80, 90 through operation of the pedal 54. When the surface of high friction material is in contact with the wheel or hub the brake is in its first state, and when the surface of high friction material is out of contact with the wheel or hub the brake is in its second state. A plurality of such members may be provided, one per castor. In other embodiments, the member may be selectively locatable in a hole in the interior or exterior of the wheel 64, 74, 84, 94 or hub 65, 75, 85, 95 of the castor through operation of the pedal 54, so as to positively lock, i.e. prevent, rotation of the wheel 64, 74, 84, 94 and hub 65, 75, 85, 95 relative to the pins 67*a*, 67*b*. A plurality of such members may be provided, one or more per castor. In still other embodiments, the brake comprises a device movably connected to the chassis 50 and having a surface of high friction material, such as rubber, that is selectively contactable with the floor 6 through operation of the pedal 54. When the surface of high friction material is in contact with the floor the brake is in its first state, and when the surface of high friction material is out of contact with the floor the brake is in its second state. In further embodiments, the brake may be an electrical brake that selectively opposes rotation of the motor 66. Other forms of brake also are contemplated.

As mentioned above, the drive system 100 comprises a brake state determiner 130 communicatively connected to the controller 200. The brake state determiner 130 is configured to determine, e.g. sense, a state of the brake and to indicate to the controller 200 the state of the brake, in dependence on the state of the brake. In dependence on the indication received from the brake state determiner 130, the controller 200 determines whether or not to control the motor 66 to cause the rotation of the first wheel 64 relative to the frame 62 and chassis 50 thereby to drive the surgical table 2 along the floor 6. That is, the drive system 100 is for causing rotation of the first wheel 64 relative to the frame 62 and chassis 50 thereby to drive the surgical table 2 along the floor 6 in dependence on the state of the brake. Specifically, in the illustrated embodiment, the drive system 100 is operable to cause the rotation only when the brake is in its second state. That is, causation of the rotation by the drive system 100 is possible only when the brake is in its second state.

As also mentioned above, the drive system 100 also comprises a power supply monitor 150 communicatively connected to the controller 200 and connected to the power supply 300. The power supply monitor 150 is configured to determine a state of the power supply 300 and to indicate to the controller 200 the state of the power supply 300, in dependence on the determined state of the power supply 300. More specifically, in the illustrated embodiment the power supply 300 is an electrical power supply comprising one or more cells or batteries, and the power supply monitor 150 is connected to the power supply 300 in order to determine a degree of charge of the one or more cells or batteries, and to output to the controller 200 an indication indicative of the degree of charge in dependence on the determined degree of charge.

In dependence on the indication received from the power supply monitor 150, the controller 200 determines whether or not to control the motor 66 to cause the rotation of the first wheel 64 relative to the frame 62 and chassis 50 thereby to drive the surgical table 2 along the floor 6. That is, the drive system 100 is for causing rotation of the first wheel 64 relative to the frame 62 and chassis 50 thereby to drive the surgical table 2 along the floor 6 in dependence on the state of the power supply 300, more specifically in dependence on a degree of charge of the one or more cells or batteries. In the illustrated embodiment, the drive system 100 is operable to cause the rotation only when the degree of charge is above a predetermined threshold degree of charge, e.g. above 20% or above 40% possible total charge. That is, causation of the rotation by the drive system 100 is possible only when the degree of charge is above the predetermined threshold degree of charge. Thus, the drive system 100 is operable to cause the rotation only when the indication output by the power supply monitor 150 comprises an indication that the degree of charge of the one or more cells or batteries is above the predetermined threshold degree of charge.

Accordingly, in the illustrated embodiment of the present invention, the drive system 100 is for causing (i.e. is operable to cause) the rotation of the first wheel 64 relative to the frame 62 and chassis 50 thereby to drive the surgical table 2 along the floor 6 in dependence on the following factors: the state of the dead man's switch 120, the state of the brake, the height of the column 8, and the state of the power supply 300. The drive system 100 is configured so that disposing the selector 110 in its second mode (or third mode, in the variation embodiment discussed above) causes the drive system 100 to cause the rotation only when all the following conditions are true: (a) the dead man's switch 120 is in its second state, (b) the brake is in its second state, (c) the height of the column 8 is below the predetermined threshold height, and (d) the degree of charge of the power supply 300 is above the predetermined threshold degree of charge. Moreover, the drive system 100 is configured to cause the rotation at a specific rotational speed corresponding to the sub-mode in which the selector 110 is disposed, i.e. corresponding to a position of the knob or dial in the present embodiment.

Since the drivable wheel 64 is comprised in the first swivel castor 60, there is provided a very compact mechanism for driving the surgical table 2 along the floor 6, as compared to a surgical table 2 in which the drivable wheel is a fifth wheel, such as a fifth wheel located towards the middle of the base 4 adjacent the column 8. In such a comparative surgical table, the provision of the drivable wheel means that the system for driving the surgical table 2 along the floor 6 is of increased volume, and the location of the drivable wheel might restrict how low the tabletop 10 can be lowered, if the table include a column of adjustable height.

Since in the illustrated embodiment the selector 110 is located on the handlebar 400 at one longitudinal end of the table 2, the surgical table 2 is more easily steered while operating the selector 110, as compared to a surgical table in which the equivalent selector is provided on a portable handset communicatively connected, but separate from, the surgical table. Accordingly, the surgical table has a drivable wheel that is safely drivable along the floor.

Moreover, since in the illustrated embodiment it is necessary to place the dead man's switch 120 in its second state, against the bias of the dead man's switch 120 to its first state, in order to be able to drive the surgical table 2 along the floor 6, it is better ensured that a driver of the surgical table 2 is paying attention to the table 2 during driving, and the table 2 cannot be driven without the driver being present and placing the dead man's switch 120 in its second state. Accordingly, the surgical table has a drivable wheel that is yet more safely drivable along the floor.

Furthermore, since in the illustrated embodiment it is necessary for the height of the column 8 to be less than a predetermined threshold height in order to be able to drive the surgical table 2 along the floor 6, it is ensured that the table 2 is stable during movement along the floor 6. Thus, the surgical table is yet more safely drivable along the floor.

Moreover, since in the illustrated embodiment it is necessary for the brake to be in its second state in order to be able to drive the surgical table 2 along the floor 6, there is provided a mechanism for avoiding inadvertent movement or jolting of the table by attempted rotation of the motor 66. This mechanism also helps to avoid wear to the motor 66 and to the brake itself.

Moreover, since in the illustrated embodiment it is necessary for the degree of charge of the power supply 300 to be above a predetermined threshold degree of charge in order to be able to drive the surgical table 2 along the floor 6, the table has a mechanism for ensuring that the power supply 300 has above a certain degree of charge for driving other systems of the table 2 that might be powered by the same power supply 300, such as the mechanisms for inclining the whole tabletop 10 relative to the column 8 and base 4 and relative to the horizontal about transverse and longitudinal axes of the tabletop 10, and/or the mechanism for selectively increasing or decreasing the height of the column 8, and/or a user interface.

In variations to the illustrated embodiment, any number and/or combination of the selector 110, dead man's switch 120, brake state determiner 130, column height determiner 140 and power supply monitor 150 may be omitted. Accordingly, in variations to the illustrated embodiment, the drive system may be for causing rotation of the first wheel relative to the chassis thereby to drive the surgical table along the floor in dependence on any one or more, or none, of the following factors: the mode of the selector 110, the state of a dead man's switch 120, the state of a brake, a height of the column 8, and the state of a power supply 300.

Various modifications can be made to the above-described embodiments without departing from the scope of the present invention, which is defined by the claims.

For example, in variations to the illustrated embodiment, the selector 110 may comprise a single throw switch that is positionable at one of only two discrete positions corresponding to the first and second modes of the selector 110, the first position and mode corresponding to a desired rotation speed of the wheel of zero, and the second position and mode corresponding to a certain, single desired positive (i.e. forward) rotation speed of the wheel. In further embodiments, the selector 110 may comprise a double throw switch that is positionable at one of only three discrete positions corresponding to first, second and third modes of the selector 110, the first position and mode corresponding to a desired rotation speed of the wheel of zero, the second position and mode corresponding to a certain, single desired positive (i.e. forward) rotation speed of the wheel, and the third position and mode corresponding to a certain, single desired negative (i.e. reverse) rotation speed of the wheel.

In other variations to the illustrated embodiment, more than one of the wheels 64, 74, 84, 94 may be drivable by the drive system to drive the table 2 along the floor 6. For example, the second castor 70 may comprise a second hub 75 and the second wheel 74, and an electric motor disposed within the second hub 75 may be rotatably connected to pins of the second castor 70, similar to pins 67*a*, 67*b* of the first castor 60. In such an embodiment, the drive system may be for causing rotation of the motors, to cause rotation of the first and second wheels 64, 74 and the first and second hubs 65, 75 relative to the respective frames 62, 72 and the chassis 50 thereby to drive the surgical table 2 along the floor 6.

The invention claimed is:

1. A surgical table comprising:

a base comprising a chassis and rotatably connected to the chassis a plurality of wheels for supporting the surgical table on a floor, wherein a total number of the plurality of wheels for supporting the surgical table on the floor is only four, a first of the four wheels being driven and comprised in a swivel castor rotatably connected to the chassis;

a column extending from the chassis;

a tabletop coupled to the column and providing a patient support surface, the tabletop having a longitudinal direction; and a drive system for causing a rotation of the first wheel relative to the chassis thereby to drive the surgical table along the floor, wherein the swivel castor comprises a frame rotatably connected to the chassis for free rotation about 360 degrees about a first axis relative to the chassis, wherein an orientation of the frame is lockable relative to the chassis with the first wheel being longitudinally oriented relative to the longitudinal direction of the tabletop, and the first wheel rotatably connected to the frame about a second axis orthogonal to the first axis and comprising an integral electric motor, and wherein the chassis has first and second opposed end portions, wherein the four wheels consist of the first wheel at the first end portion, a second wheel comprised in a second swivel castor at the first end portion, wherein the second swivel castor is not driven, and third and fourth wheels at the second end portion.

2. The surgical table according to claim 1, wherein the third and fourth wheels are comprised in respective third and fourth swivel castors.

3. The surgical table according to claim 1, wherein the third and fourth wheels are third and fourth fixed wheels.

4. The surgical table according to claim 1, comprising a handlebar at one end of the tabletop, wherein the drive system comprises a selector mounted on the handlebar for selecting a speed at which the drive system rotates the first wheel.

5. The surgical table according to claim 4, wherein the selector is disposable in first and second modes, and wherein the drive system is for causing the rotation in dependence on the mode of the selector.

6. The surgical table according to claim 4, wherein with respect to the longitudinal direction of the tabletop, the handlebar is at one longitudinal end of the tabletop, and/or wherein the handlebar is removably fixed to the tabletop.

7. The surgical table according to claim 6, wherein the tabletop has a transverse direction orthogonal to the longitudinal direction, and at least a portion of the handlebar is elongate in the transverse direction.

8. The surgical table according to claim 5, wherein the drive system is configured to not cause the rotation when the selector is in the first mode.

9. The surgical table according to claim 5, wherein the drive system is configured to cause the rotation when the selector is in the second mode.

10. The surgical table according to claim 4, wherein the selector is for selecting a direction in which the drive system rotates the first wheel.

11. The surgical table according to claim 1, wherein the drive system comprises a dead man's switch that is switchable between first and second states and biased to the first state, and the drive system is for causing the rotation in dependence on the state of the dead man's switch.

12. The surgical table according to claim 11, wherein the drive system is configured to not cause the rotation when the dead man's switch is in the first state.

13. The surgical table according to claim 11, wherein the drive system is for causing the rotation only when the dead man's switch is in the second state.

14. The surgical table according to claim 11, wherein the selector is disposable in first and second modes, the drive system is for causing the rotation in dependence on the mode of the selector, and the drive system is configured to cause the rotation when the selector in the second mode only when the dead man's switch is in the second state.

15. The surgical table according to claim 11, comprising a handlebar at one end of the tabletop, wherein the drive system comprises a selector mounted on the handlebar for selecting a speed at which the drive system rotates the first wheel and wherein the dead man's switch is mounted on the handlebar.

* * * * *